US006250365B1

(12) United States Patent
Flemings et al.

(10) Patent No.: US 6,250,365 B1
(45) Date of Patent: Jun. 26, 2001

(54) DIE CASTING PROCESS

(75) Inventors: Merton C. Flemings, Cambridge, MA (US); Sergio Gallo, Turin (IT)

(73) Assignee: Teksid S.p.A., Turin (IT)

( * ) Notice: Subject to any disclaimer, the term of this patent is extended or adjusted under 35 U.S.C. 154(b) by 0 days.

(21) Appl. No.: 09/349,518

(22) Filed: Jul. 9, 1999

Related U.S. Application Data

(60) Provisional application No. 60/120,576, filed on Feb. 18, 1999.

(51) Int. Cl.[7] ..... B22C 9/08; B22D 17/00

(52) U.S. Cl. ..... 164/113; 164/312; 164/342; 164/359

(58) Field of Search ..... 164/113, 312, 164/342, 359

(56) References Cited

U.S. PATENT DOCUMENTS 3,959,433 * 5/1976 Sauers ..... 264/328

* cited by examiner

*Primary Examiner*—Kuang Y. Lin
(74) *Attorney, Agent, or Firm*—Elizabeth E. Nugent; Choate, Hall & Stewart

(57) ABSTRACT

Apparatus and methods of die casting which reduce waste, by providing heated channels to feed solidification shrinkage. The channels are heated to a temperature which prevents solidification in the channels, thus allowing the channels to be substantially smaller than conventional risers. An insulating layer in the mold prevents excessive heat loss from the channels to the mold cavity area.

12 Claims, 2 Drawing Sheets

DIE CASTING PROCESS

This application claims benefit of provisional application Ser. No. 60/120,576 filed Feb. 18, 1999.

FIELD OF THE INVENTION

The present application relates to the die casting of metals, and particularly to methods and apparatus for reducing waste material in die casting.

BACKGROUND OF THE INVENTION

Most metal alloys undergo a volume contraction when they solidify. This volume contraction can result in a shrinkage porosity in a cast part unless an appendage, often called a "riser," of appropriate size is properly placed on the casting. The riser serves to feed the shrinkage of the metal in the mold, and is cut off after casting. Typical risers need to have volumes approaching the volume of the casting in order to produce a pore-free casting, leading to large recycling costs. This problem is particularly severe in high-purity castings, such as typical magnesium and magnesium alloy castings, because the riser may become contaminated during post-processing of the casting, and must be repurified before the metal can be used in another casting.

It is an object of the present invention to provide a method and apparatus for casting which allows riser volume to be substantially reduced.

SUMMARY OF THE INVENTION

The invention comprises apparatus and methods of die casting which reduce waste, by providing heated channels to feed solidification shrinkage. The channels are heated to a temperature which prevents solidification in the channels, thus allowing the channels to be substantially smaller than conventional risers. An insulating layer in the mold prevents excessive heat loss from the channels to the mold cavity area.

In one aspect, the invention provides a die casting apparatus, comprising a die having upper and lower sections, means for maintaining a temperature differential between the die sections, and means for introducing molten metal into the die. The two sections of the die are separated by an insulating layer, and define a die cavity which spans the two sections. The die cavity includes the mold cavity, which defines the shape of the finished casting, a riser, and a gate connecting the two. The riser is in the lower section of the die, and the mold cavity is in the upper section of the die.

The gate may be tapered from a narrower riser to a wider mold cavity. The metal introducing means may be, for example, a compressed gas, mechanical, or electromagnetic pump. The riser may be substantially vertical (so that metal travels upwardly through the gate and into the mold cavity). The insulating layer may be, for example, a ceramic or a refractory metal.

In another aspect, the invention provides methods of die casting. The methods include introducing molten (or semimolten) metal into a die cavity comprising a mold cavity, a riser, and a gate connecting the two. The mold cavity is positioned in the upper section of the die, and the riser is positioned in the lower portion of the die. The two die portions are separated by an insulating layer, that acts to limit heat transfer from the hotter lower section of the die to the cooler top section. The lower section is maintained at a temperature which keeps the metal liquid or semisolid, while the upper section is cool enough to freeze the metal to form at casting. The methods may further comprise removing the casting from the mold. The methods of the invention may be used to cast magnesium, in which case typical temperatures for the upper and lower portions of the mold may be 230° C. and 675° C., respectively.

BRIEF DESCRIPTION OF THE DRAWING

The invention is described with reference to the several figures of the drawing, in which.

DETAILED DESCRIPTION

While the description below is directed to conventional methods of liquid-based die casting, the mold of the invention may also be used for a semisold casting process, such as that disclosed in copending and commonly owned U.S. Application Ser. No. 09/228,965, filed Jan. 12, 1999, which is incorporated by reference herein.

Figure 1:
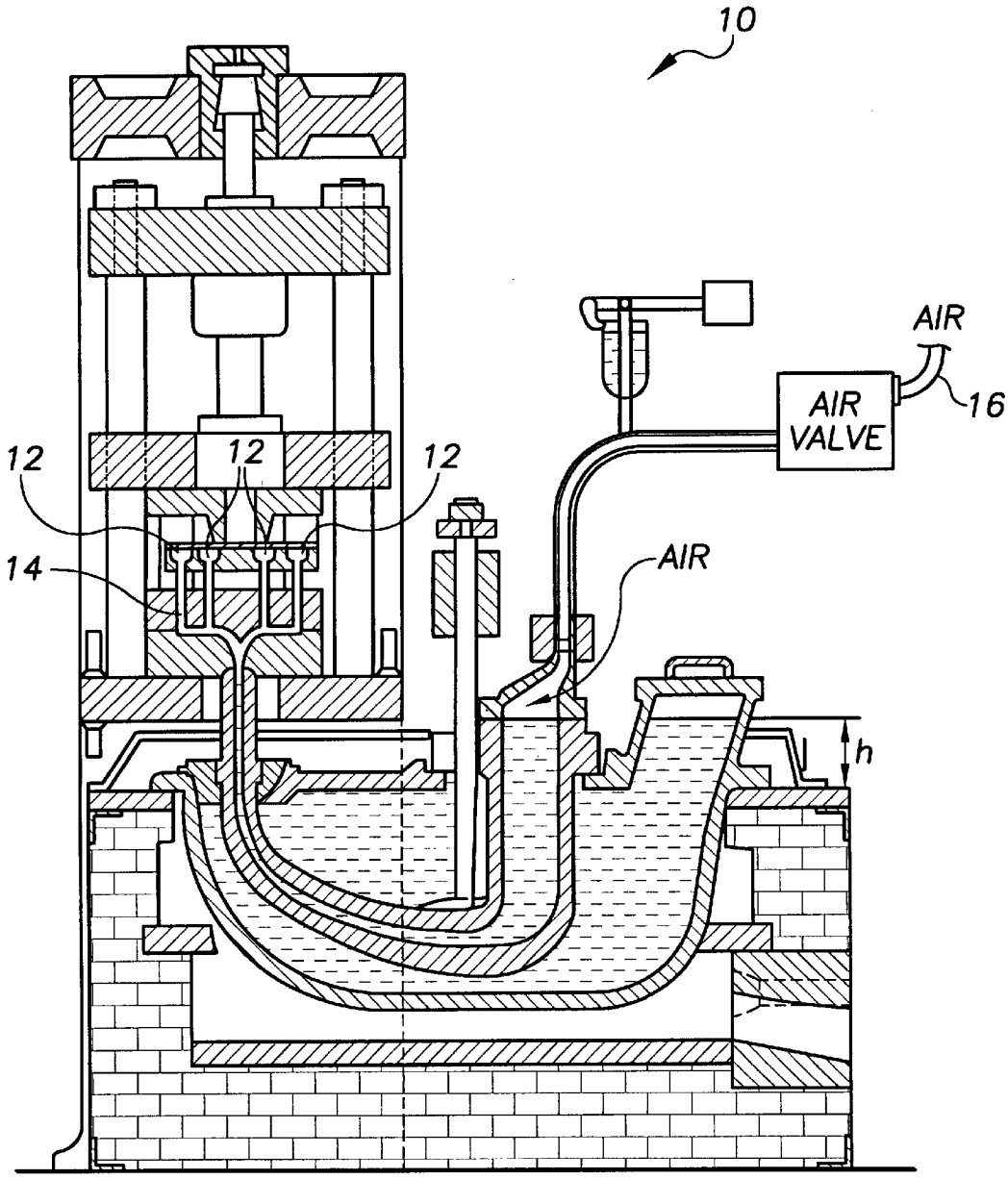
FIG. 1 shows a hot chamber die casting apparatus.

FIG. 1 shows a typical prior art hot chamber die casting apparatus 10. In the pictured caster, compressed gas is used to force molten metal into the mold. As shown, four small castings 12 are produced, with a substantial riser volume 14. As discussed above, these risers 14 must be cut from the solidified castings 12 after the metal has solidified. The continued pressure from pump 16 allows molten metal to enter the mold to feed the shrinkage of the castings 12. The compressed gas may be air for some alloys, but an inert gas is preferred for the casting of magnesium, in order to avoid excessive oxidation. Hot chamber die casters having mechanical pumps are also well known in the art and can be used with the molds of the invention.

Figure 2C:
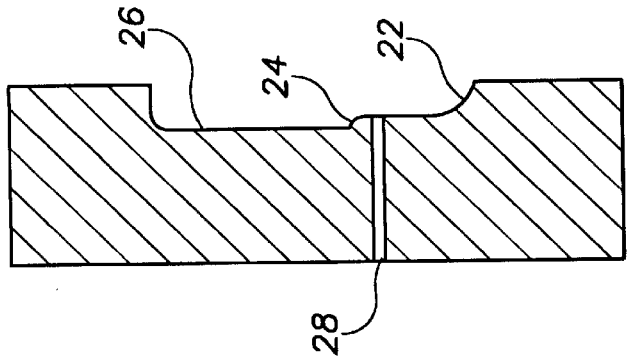
FIGS. 2*a*–2*c* show three views of one half of a die casting mold according to the invention.
Figure 2B:
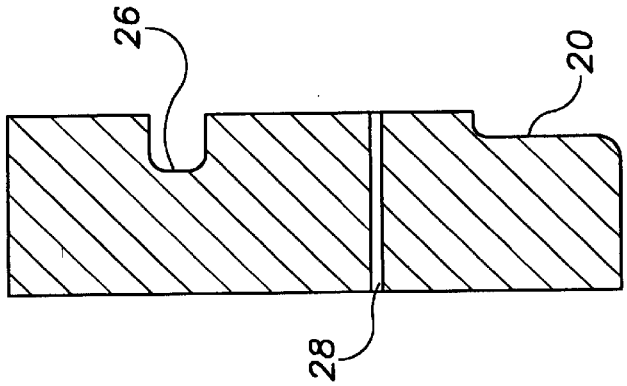
Figure 2A:
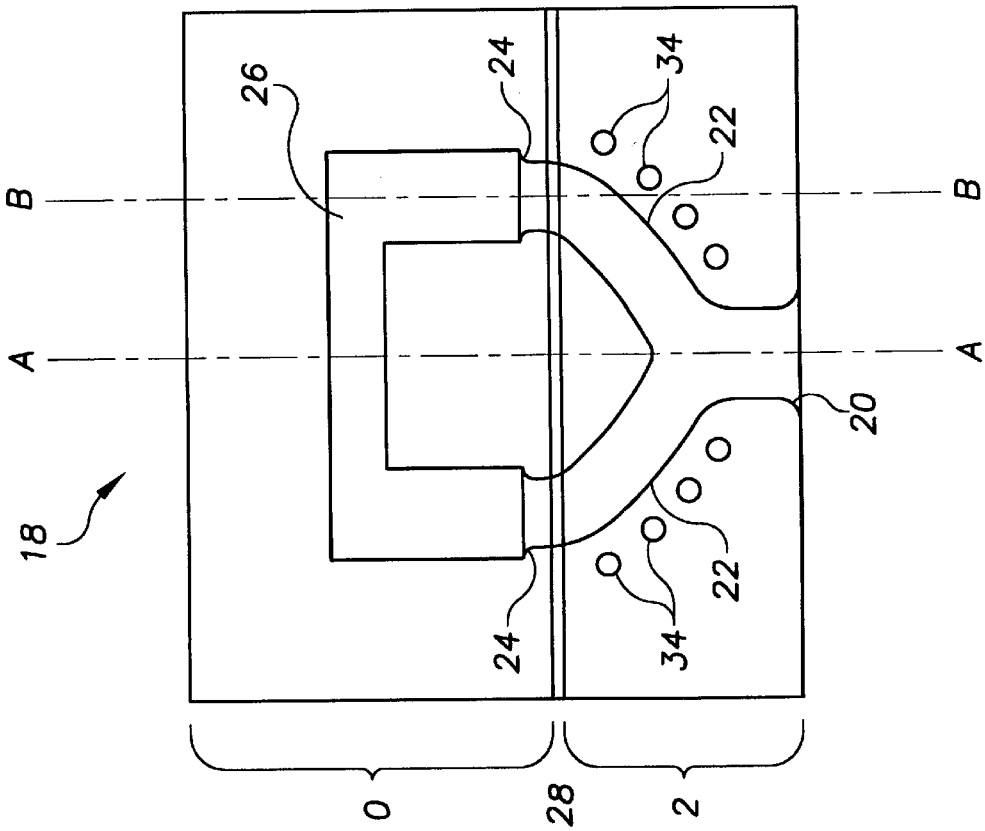

FIG. 2*a* shows a front view of one half of a die casting mold 18 according to the invention; FIGS. 2*b* and 2*c* show cross-sectional views of the same half mold along section A—A and B—B, respectively. Using the mold as pictured (with a matching mate), the produced casting will be U-shaped; those skilled in the art will see that essentially any shape castable by prior art methods can also be cast by the methods of the invention.

In use, metal enters the mold through throat 20, and flows through channels 22 towards the mold. The channels widen somewhat at gates 24 before connecting to the mold cavity 26; this will be further discussed below.

The mold comprises an insulating layer 28, which may comprise ceramic, refractory metal, or any suitable insulator of heat. The insulating layer is preferably placed just below the gates 24, and in the pictured embodiment, traverses the full width of the mold. Other insulator geometries are also contemplated, as will be further discussed hereinbelow. It is envisioned that this mold could be constructed by bolting together an upper section 30, a lower section 32, and the insulating layer 28.

The lower portion 32 of the mold further comprises heaters 34. These may be, for example, resistive, induction, or gas heaters, and may be embedded in the mold 18 as shown, or may be placed at the perimeter of the mold 18.

In use, molten metal is introduced into the mold through the neck 20, and flows through the channels 22 and gates 24 into the mold cavity 26. Heaters 34 keep the lower portion 32 of the mold at a temperature high enough to maintain fluidity of the molten metal, while conventional heating and cooling mechanisms (not shown) keep the upper portion 30 of the mold below the melting point of the molten metal at a typical casting temperature. In casting of magnesium, for example, typical temperatures for the upper and lower portions of the mold would be on the order of 230° C. and 675° C., respectively. (The melting point of magnesium is about 650° C.). The insulating layer 24 prevents excessive heat flow from the lower to the upper mold portion.

The heating of the lower mold portion means that the metal in channels 22 remains liquid (or semisolid in the case of semisolid die casting). Metal can thus flow freely through the channels 22, which may thus be made much smaller than conventional risers. Typical channel diameters are expected to be about ⅓ the size of prior art risers. Flared gates 24 allow some of the metal to freeze therein without excessively constricting shrinkage-fed flow, accommodating heat flow through the molten metal and allowing a fully solid casting to be made. It will be apparent to those skilled in the art that the temperature gradient and heat flow in the vicinity of the gates can be calculated using a knowledge of the properties of the mold and the liquid metal.

Once the casting has solidified, the back pressure on the molten metal can be released (in the caster of FIG. 1, by releasing the gas pressure from pump 16). Since the metal in the channels 22 is still liquid, it can flow back into the melt pot for reuse, leaving only the solidified metal in the casting and the gates 24. The mold can then be opened to extract the casting for finishing.

Hot chamber die casting molds are not always in the vertical position, but may be at an angle or even horizonal. Such molds may also be constructed in accordance with the invention, as long as the channels are positioned and arranged so that liquid metal can fully drain back under gravity. These molds are also usable either with the compressed-gas caster illustrated in FIG. 1 or with casters using mechanical pumps.

Further, the heated portion of the die need not be the entire lower portion as illustrated in FIG. 2, but may be a smaller insert. The entire interface between the heated and cooled portions of the die is preferably insulated to reduce energy costs.

The invention described herein is particularly applicable to the casting of magnesium alloys, where cost of recycling metal is high, there is a commercial demand for high quality castings, and relatively inexpensive mold materials are available that do not corrode excessively in the presence of the molten metal. Metals suitable for casting of magnesium alloys in accordance with the invention include standard die steels and other high temperature alloys.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A die casting apparatus, comprising:

a die having an upper and a lower section, the sections separated by a layer of insulating material, the sections defining a die cavity spanning the insulating layer, the cavity including a riser in the lower section of the die, a mold cavity in the upper section of the die, and a gate connecting the riser to the mold cavity;

means for maintaining a temperature differential between the die sections, the upper section being held at a lower temperature than the lower section; and means for introducing molten or semimolten metal under pressure into the mold cavity via the riser and the gate.

2. The die casting apparatus of claim 1, wherein the gate is tapered from a narrower portion connected to the riser to a wider portion connected to the mold cavity.

3. The die casting apparatus of claim 1, wherein the metal introducing means comprise a compressed gas pump.

4. The die casting apparatus of claim 1, wherein the metal introducing means comprise a mechanical pump.

5. The die casting apparatus of claim 1, wherein the metal introducing means comprise an electromagnetic pump.

6. The die casting apparatus of claim 1, wherein the riser is substantially vertical.

7. The die casting apparatus of claim 1, wherein the insulating layer comprises a ceramic or a refractory metal.

8. A method of die casting, comprising:

introducing molten or semimolten metal into a die casting apparatus comprising a die having an upper and a lower section, the sections separated by a layer of insulating material and defining a die cavity spanning the insulating layer, the cavity including a riser in the lower section of the die, a mold cavity in the upper section of the die, and a gate connecting the riser to the mold cavity, the metal being introduced into the mold cavity via the riser and the gate;

maintaining the lower section at a temperature sufficient to render the metal liquid or semisolid; and maintaining the upper section at a temperature selected to freeze at least a portion of the metal in the mold cavity of the die to form a casting, wherein the insulating layer acts to retard heat transfer from the lower layer to the upper layer.

9. The method of claim 8, further comprising removing the casting from the mold cavity.

10. The method of claim 8, wherein the gate is tapered from a narrower portion connected to the riser to a wider portion connected to the mold cavity.

11. The method of claim 8, wherein the metal is magnesium.

12. The method of claim 11, wherein the upper section of the mold is held at about 230° C., and the lower section of the mold is held at about 675° C.

* * * * *